US011478806B2

(12) United States Patent
Fukanuma

(10) Patent No.: US 11,478,806 B2
(45) Date of Patent: Oct. 25, 2022

(54) COLD SPRAY GUN AND COLD SPRAY APPARATUS EQUIPPED WITH THE SAME

(71) Applicant: Plasma Giken Co., Ltd., Yoriimachi (JP)

(72) Inventor: Hirotaka Fukanuma, Yoriimachi (JP)

(73) Assignee: Plasma Giken Co., Ltd., Yoriimachi (JP)

( * ) Notice: Subject to any disclaimer, the term of this patent is extended or adjusted under 35 U.S.C. 154(b) by 0 days.

(21) Appl. No.: 16/500,646

(22) PCT Filed: Apr. 2, 2018

(86) PCT No.: PCT/JP2018/014118
§ 371 (c)(1),
(2) Date: Oct. 3, 2019

(87) PCT Pub. No.: WO2018/186351
PCT Pub. Date: Oct. 11, 2018

(65) Prior Publication Data

US 2020/0108405 A1 Apr. 9, 2020

(30) Foreign Application Priority Data

Apr. 4, 2017 (JP) ..... JP2017-074481

(51) Int. Cl.
*B05B 7/14* (2006.01)
*B05B 7/16* (2006.01)
*C23C 24/04* (2006.01)

(52) U.S. Cl.
CPC ..... *B05B 7/1486* (2013.01); *B05B 7/14* (2013.01); *B05B 7/16* (2013.01); *B05B 7/162* (2013.01); *C23C 24/04* (2013.01)

(58) Field of Classification Search
CPC ..... B05B 7/1486; B05B 7/16; B05B 7/162; B05B 7/14; B05B 7/1613; C23C 24/04; B05C 19/04
(Continued)

(56) References Cited

U.S. PATENT DOCUMENTS 2,101,922 A * 12/1937 Stoesling ..... B05B 7/1666 427/314
5,302,414 A 4/1994 Alkhimov et al.
(Continued)

FOREIGN PATENT DOCUMENTS

CN 1603008 A 4/2005
JP 2007146281 A 6/2007
(Continued)

*Primary Examiner* — Laura Edwards
(74) *Attorney, Agent, or Firm* — The Webb Law Firm

(57) ABSTRACT

Disclosed is a cold spray gun and a cold spray apparatus using the same capable of stably heating a raw material powder to a specific high temperature with an achievement of compactness and lightweight of the apparatus. In order to achieve the above described object, there is provided a cold spray gun configured to form a coating film by spraying a raw material powder carried on a carrier gas from a nozzle outlet by a supersonic flow together with a working gas heated to a temperature equal to or lower than a melting point or a softening point of the raw material powder, and causing the raw material powder to collide with a base material in a solid state, the cold spray gun including; a chamber containing the working gas to be delivered to the nozzle; and is characterized in that a gas heating pipe constituted from a heating resistor which causes resistance heating by being energized is arranged in the chamber, and the working gas flowing into the interior of the gas heating pipe is heated.

7 Claims, 4 Drawing Sheets

(58) Field of Classification Search
USPC ..... 118/302, 308; 239/135
See application file for complete search history.

(56) References Cited

U.S. PATENT DOCUMENTS

| | | | | |
|---|---|---|---|---|
| 6,913,207 | B2 * | 7/2005 | Miyamoto | C23C 4/12 239/135 |
| 9,433,957 | B2 * | 9/2016 | Nardi | B22F 9/14 |
| 2001/0042508 | A1 | 11/2001 | Kay et al. | |
| 2003/0232132 | A1 | 12/2003 | Muehlberger | |
| 2007/0221746 | A1 | 9/2007 | Heinrich et al. | |
| 2014/0312523 | A1 | 10/2014 | Kawashita et al. | |

FOREIGN PATENT DOCUMENTS

| | | | |
|---|---|---|---|
| JP | 2009531167 | A | 9/2009 |
| JP | 201194201 | A | 5/2011 |
| WO | 2011052751 | A1 | 5/2011 |

* cited by examiner

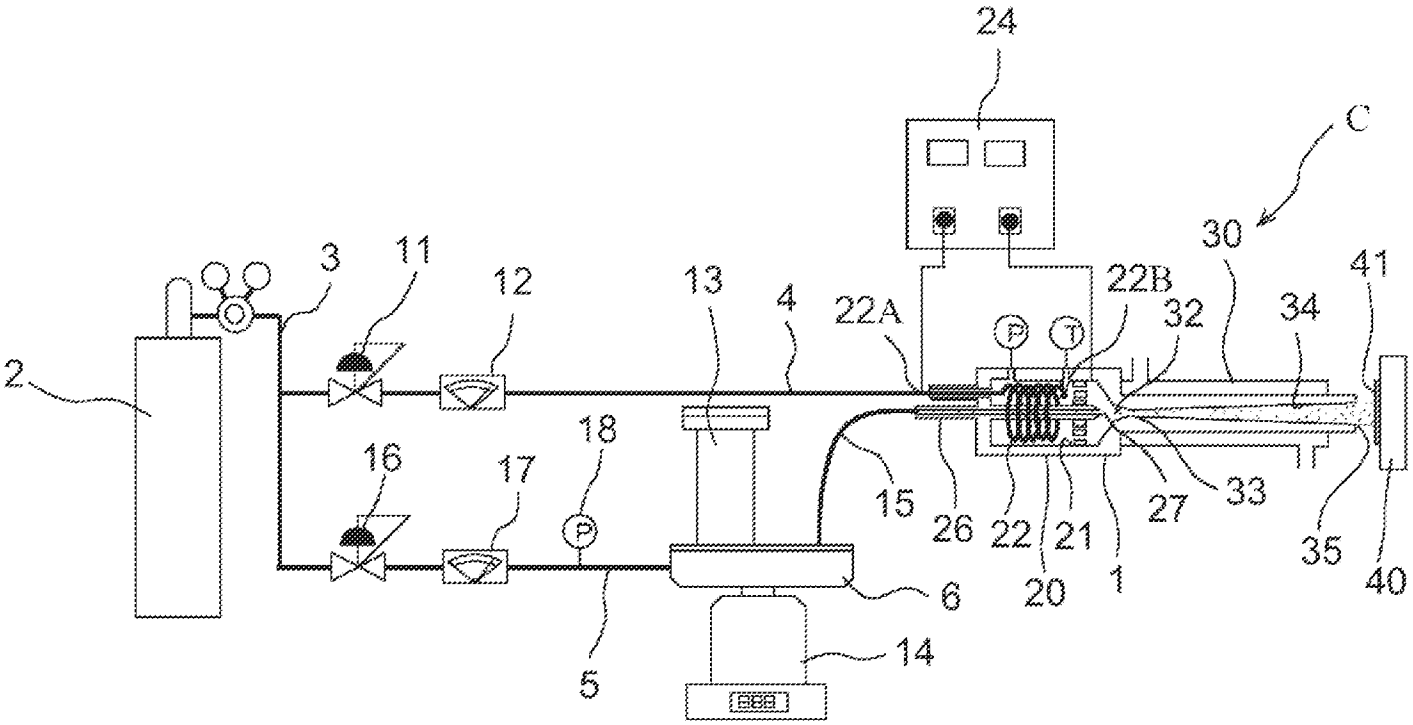
[Figure 1]

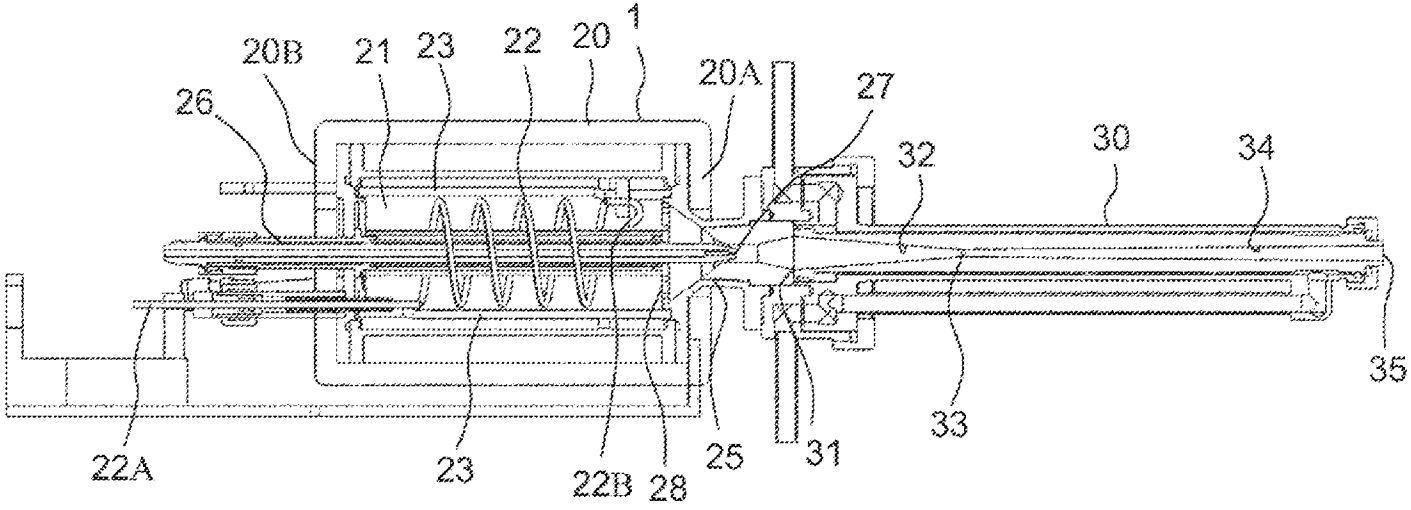
[Figure 2]

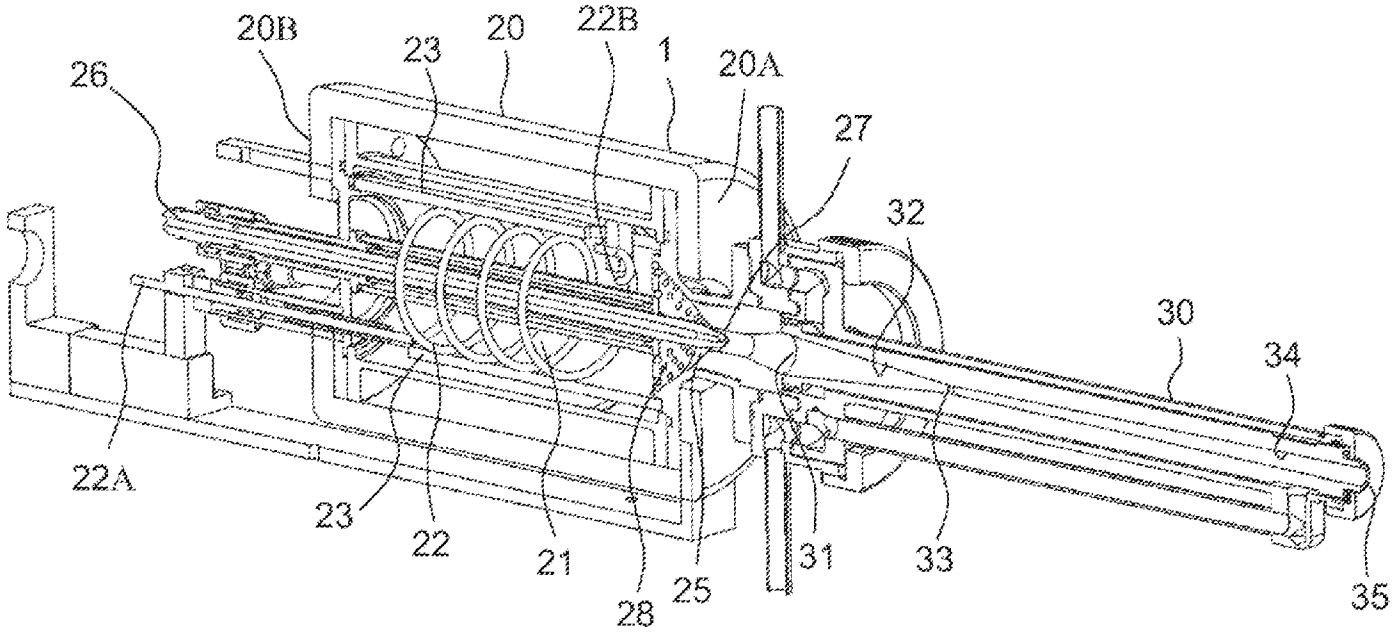
[Figure 3]

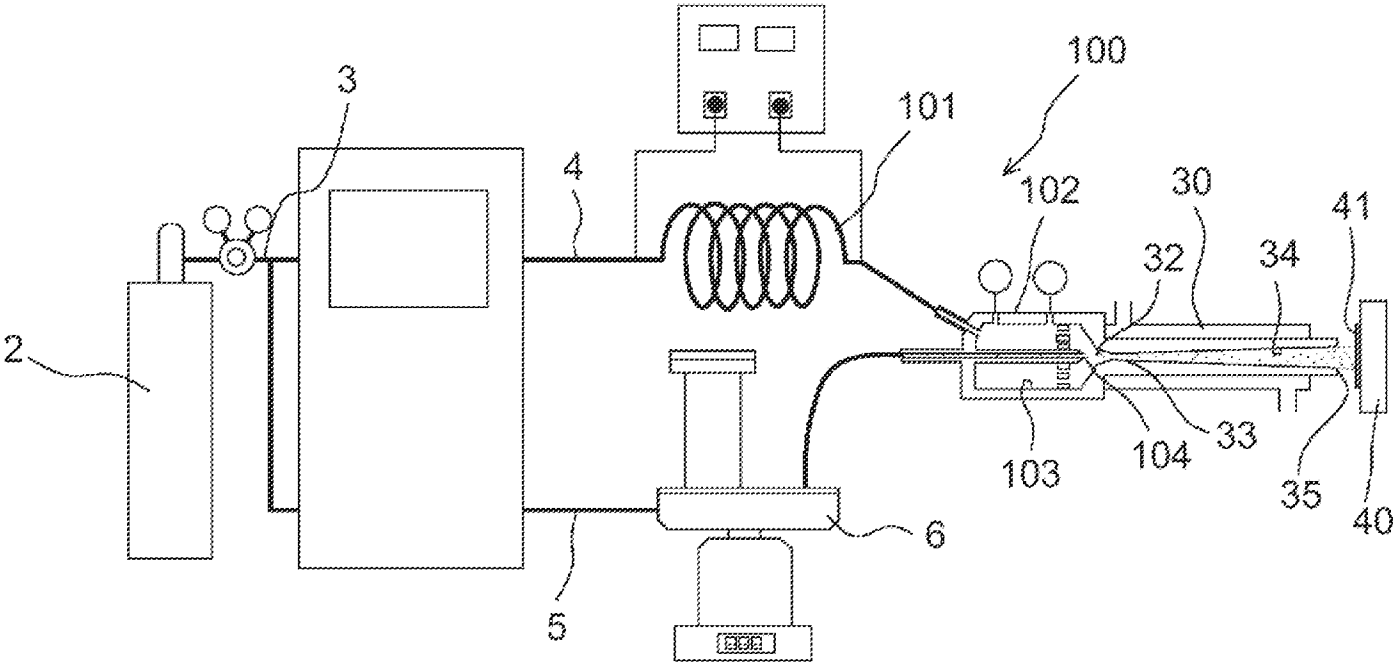
[Figure 4] -- Prior Art --

COLD SPRAY GUN AND COLD SPRAY APPARATUS EQUIPPED WITH THE SAME

CROSS-REFERENCE TO RELATED APPLICATIONS

This application is the United States national phase of International Application No. PCT/JP2018/014118 filed Apr. 2, 2018, and claims priority to Japanese Patent Application No. 2017-074481 filed Apr. 4, 2017, the disclosures of which are hereby incorporated by reference in their entirety.

TECHNICAL FIELD

The invention disclosed in the present filing relates to a cold spray gun and a cold spray apparatus equipped with the same, which are capable of spraying a raw material powder at a high speed from a nozzle together with a working gas and causing the raw material powder to collide with a base material in a solid state to form a coating film. The invention disclosed in the present filing relates in particular to heating of the working gas.

TECHNICAL CONSIDERATIONS

In the related art, for the purpose of improving wear resistance and corrosion resistance, a technique for forming a coating film such as nickel, copper, aluminum, chromium or alloys thereof has been employed for various metal parts. Examples of typical methods for forming a coating film include an electroplating method, an electroless plating method, a sputtering vapor deposition method, a plasma thermal spraying method, and the like. In recent years, a thermal spray method and a cold spray method have been attracting attention as a method for changing these methods.

The thermal spray methods include reduced pressure plasma spraying (LPPS), flame spraying, high speed flame spraying (HVOF), atmospheric plasma spraying, and the like. In these thermal spraying methods, a coating film is formed by heating a coating film-forming material and causing the heated coating film-forming material to collide with the surface of a base material at a high speed in the state of molten or semi-melted fine particles.

In contrast, the cold spray method is a method in which a raw material powder transported on a carrier gas is sprayed out from a powder port and charged into a chamber of a cold spray gun supplied with a high-pressure working gas, and the working gas containing the raw material powder is sprayed as a supersonic flow, and the raw material powder is caused to collide with the base material in a solid state to form a coating film. At this time, the temperature of the working gas in the cold spray gun is set to a temperature lower than a melting point or a softening point of the raw material powder such as metals, alloys, intermetallic compounds, and ceramics, which form the coating film. Therefore, it is known that a metallic coating film formed using a cold spray method is less susceptible to oxidation or thermal deterioration than metallic coating films of the same kind formed by using the method of the related art as described above, and is excellent in adhesion with compact and a high density, and at the same time, has a high conductivity and a high thermal conductivity.

FIG. 4 is a schematic diagram illustrating a schematic construction of a cold spray apparatus 100 of the related art. A gas supply line 3 from a compressed gas cylinder 2 storing a high-pressure gas such as nitrogen gas, helium gas, air or the like is branched into a working gas line 4 and a carrier gas line 5. The working gas line 4 is provided with a heater 101 composed of an electric resistance heating element having a working gas flow path formed in the interior thereof. The working gas that has flowed into the working gas line 4 is heated to a temperature equal to or lower than the melting point or softening point of the raw material powder in the heater 101, and then is introduced into a chamber 103 of the cold spray gun 102.

The carrier gas line 5 is provided with a raw material powder feeding device 6, and the carrier gas flowing into the carrier gas line 5 is introduced into the raw material powder feeding device 6 and is supplied to the working gas from a powder port 104 in the chamber 103 of the cold spray gun 102 by entraining the raw material powder.

A cold spray nozzle 30 is attached to a distal end of the chamber 103. Accordingly, the working gas in the chamber 103 entrains the raw material powder supplied from the powder port 104, becomes a supersonic flow by passing through a throat portion 33 from a conical tapered portion 32 of the cold spray nozzle 30, and is sprayed from a nozzle outlet 35 located at the distal end of the conical expanded portion 34. The raw material powder sprayed from the cold spray nozzle 30 collides with the surface of a base material 40 in a solid state and accumulates to form a coating film 41.

In this cold spray method, the velocity and temperature of the raw material powder particles colliding with the base material greatly affect the efficiency of coating film deposition. Specifically, the velocity of the raw material powder particles depends on the gas velocity, and the gas velocity increases in proportion to the square root of the gas temperature within the chamber. The performances of the cold spray coating film are greatly affected by the collision speed of the raw material powder particles, and as a general result, the higher the collision speed, the more compact the coating film having a high adhesion force can be formed. In order to obtain faster particle velocities, it is desirable to make the temperature of the gas as high as possible. The gas pressure also affects the velocity of the raw material powder particles. Specifically, when the particles are introduced into gas streams of an equal linear velocity and different pressures, the gas flow with a high pressure, that is, gas flow with high gas density, is stronger in force to accelerate the particles than a gas flow with a low pressure, that is, a gas flow with a low gas density, and thus the particles move at a higher velocity.

For example, U.S. Pat. No. 5,302,414 discloses the use of a gas dynamic spray method for introducing particles of a powder composed of at least one first material selected from a group consisting of metals, alloys, polymers and mechanical mixtures of metals into a gas to apply a coating to an article, wherein a heating element made of a spiral resistor alloy of a thin tube in which the gas flows is used as means for heating the gas to be supplied to the premixing chamber.

Further, National Publication of International Patent Application No. 2009-531167 discloses a cold gas spray gun including: a high-pressure gas heater including a cylindrical pressure vessel through which a gas flow to be heated flows and a heater arranged in the interior of the pressure vessel; a mixing chamber capable of supplying particles from an exterior into the gas flow passing through an interior through a particle supply pipe; and convergent passage converging towards downstream and then a Laval nozzle continuing to a diffusion passage through the nozzle throat portion, in which a high-pressure gas heater, a mixing chamber and a Laval nozzle are sequentially connected from an upstream side of the gas flow, and at least a part of a contact surface between a high-pressure gas heater and a gas flow in the interior of the mixing chamber is insulated.

[Patent Literature 1] U.S. Pat. No. 5,302,414

[Patent Literature 2] National Publication of International Patent Application No. 2009-531167

SUMMARY OF INVENTION

Technical Problem

Summary

In a pipe made of a spiral resistor alloy used for gas heating as described in U.S. Pat. No. 5,302,414, since the working gas flowing in the interior has a high pressure, a pressure difference between the interior and the exterior of the pipe becomes larger when the pipe is heated to a high temperature, which leads to a risk of deformation or rupture. In particular, when the temperature of the pipe used for heating becomes higher than the temperature at which a yield stress of the material constructing the pipe becomes low, the risk of rupture of the pipe will become higher due to a pressure difference between the interior and the exterior of the pipe. Therefore, the pressure in the pipe must be suppressed to at most 5 MPa.

Further, since the pipe is equipped with a specific pressure-resistant structure, the pipe thickness is large and the heat capacity is large. Therefore, a large amount of electric power is required to stabilize the temperature of the working gas flowing in the interior, and even when the pipe is provided with a casing, heat loss due to heat spreading from the surface of the pipe surface is large. Therefore, the heating means disclosed in U.S. Pat. No. 5,302,414 has a problem in that the energy efficiency is poor. In addition, in order to secure a required amount of heat, it is necessary to increase the capacity of the heating means, which may cause a problem of resulting in an increase in the size of the entire apparatus.

Therefore, as described in National Publication of International Patent Application No. 2009-531167, there has been developed a cold gas spray gun equipped in an interior of the pressure vessel with a heater. However, in U.S. Pat. No. 5,302,414, since the heater is a filament heater composed of heating wires in a form of a large number of filaments, there is a problem in that the heating wires are liable to break. Therefore, there is a problem that it is difficult to operate stably for a long time.

In addition, in the conventional cold spray apparatus represented by Patent Literature 1 and Patent Literature 2, when a coating film is formed by using a metal material having a melting point or a softening point of 1000° C. or lower, sufficient coating film performances can be achieved. However, it is not suitable for forming a coating film by using a metal material having a higher melting point or softening point. In order to form a compact and highly adhesive coating film, it is necessary to heat the working gas to a temperature close to the melting point or the softening point of the metal material to be used. However, in the conventional cold spray apparatus, heating the working gas to a temperature higher than 1000° C. actually has a lot of obstacles, and it has been difficult to realize sufficient coating film performances for a metal material or the like having a melting point or a softening point exceeding 1000° C.

It is therefore an object of the present invention to provide a cold spray gun and a cold spray apparatus using the same capable of stably heating a raw material powder to a specific high temperature with an achievement of a compact and lightweight apparatus.

Accordingly, disclosed herein is an improved cold spray gun and a cold spray apparatus using the same. Hereinafter, a "cold spray gun" and a "cold spray apparatus" will be separately described.

The cold spray gun according to the present invention is configured to form a coating film by spraying a raw material powder conveyed on a carrier gas from a nozzle outlet by a supersonic flow together with a working gas heated to a temperature equal to or lower than a melting point or a softening point of the raw material powder, and causing the raw material powder to collide with a base material in a solid state, the cold spray gun including a chamber containing the working gas to be delivered to the nozzle; and is characterized in that a gas heating pipe constituted from a heating resistor which causes resistance heating by being energized is arranged in the chamber, and the working gas flowing into the interior of the gas heating pipe is heated.

In the cold spray gun according to the present invention, it is preferable that the gas heating pipe be a coil heater including a working gas flow passage is formed in the interior thereof.

In the cold spray gun according to the present invention, it is preferable that the gas heating pipe be drawn out of the chamber at the working gas inlet side end, and be opened in the chamber at a working gas outlet side end.

In the cold spray gun according to the present invention, it is preferable that the gas heating pipe be held in the chamber via an insulation part, and the working gas outlet side end be arranged in contact with the chamber inner wall.

<Cold Spray Apparatus According to the Present Invention>

A cold spray apparatus according to the present invention is characterized in being equipped with a cold spray gun as described above.

According to the cold spray gun of the present invention, the gas heating pipe constituted from a heating resistor and through which the working gas flows is arranged in the chamber containing the working gas to be sent to the nozzle. Therefore, the pressure difference between an interior of the gas heating pipe and an interior of the chamber is reduced, so that a load applied to the gas heating pipe is reduced. Therefore, even if the pressure of the working gas in the gas heating pipe is set to be high, there is little fear of deformation or rupture of the gas heating pipe. Therefore, since the pressure difference between the interior and the exterior of the heating pipe is extremely low as compared with the method in the related art, it is possible to prevent the heating pipe from being destroyed even if the gas heating temperature is increased to a temperature, for example, 1200° C., at which the yield stress of the material of the gas heating pipe is extremely low. For example, in the conventional heating method, when the temperature of the heater is set to 1000° C., the pressure difference between the interior and the exterior of the heating pipe is limited to about 5 MPa, but according to the present invention, the pressure difference between the inside and outside of the gas heating pipe can be set to about 0.5 MPa. Therefore, even if the temperature of the gas heating pipe is increased to 1200° C., there is no fear that the heating pipe will be destroyed. Therefore, according to the present invention, since the temperature of the working gas can be set to a higher temperature than that of the method of the related art, it is possible to realize a particle speed which is faster than the method of the related art by approximately 100 to 150 m/s. Therefore, it is possible to realize a coating film formation which is more compact and superior in mechanical performances.

In addition, in the cold spray gun according to the present invention, since the gas heating pipe is arranged in the chamber in which the high-temperature and high-pressure working gas is contained, the heat loss of the gas heating pipe is reduced. Further, as described above, since the temperature of the gas heating pipe can be set to be higher than the method of the related art, the linear velocity of the working gas can be increased. Therefore, the thickness of the boundary film between the inner wall of the gas heating pipe and the working gas can be reduced, and the heat transfer efficiency from the gas heating pipe to the working gas flowing through the gas heating pipe can be further improved. Therefore, the energy consumption can be significantly reduced as compared with the case where an apparatus for heating the working gas is provided outside the chamber, thereby achieving compactness and lightweight of the entire apparatus.

BRIEF DESCRIPTION OF DRAWINGS

FIG. 1 is a schematic diagram illustrating a schematic construction of a cold spray apparatus according to the present embodiment;

FIG. 2 is a schematic cross-sectional view of a cold spray gun according to the present embodiment;

FIG. 3 is a cross-sectional perspective view of the cold spray gun of FIG. 2; and FIG. 4 is a schematic diagram illustrating a schematic construction of a cold spray apparatus of the present invention prior art.

DETAILED DESCRIPTION

The present invention is a cold spray gun configured to form a coating film by spraying a raw material powder carried on a carrier gas from a nozzle outlet by a supersonic flow together with a working gas heated to a temperature equal to or lower than a melting point or a softening point of the raw material powder, and causing the raw material powder to collide with a base material in a solid state, the cold spray gun including; a chamber containing the working gas to be delivered to the nozzle; and is characterized in that a gas heating pipe constituted from a heating resistor that causes resistance heating by being energized is arranged in the chamber, and the working gas flowing into the interior of the gas heating pipe is heated. Hereinafter, an embodiment of a cold spray apparatus using a cold spray gun according to the present invention will be described with reference to the accompanying drawings.

FIG. 1 is a schematic diagram illustrating a schematic construction of a cold spray apparatus C according to the present embodiment. The cold spray apparatus C according to the present embodiment includes; a cold spray gun 1 according to the present invention; a raw material powder feeding device 6 for supplying raw material powder to the cold spray gun 1 together with a carrier gas, and a compressed gas supply unit configured to supply a specific pressure working gas to the cold spray gun 1 and supplying a carrier gas having a specific pressure to the raw material powder feeding device 6.

Any compressed gas supply unit can be used as long as the compressed gas supply unit can supply the high-pressure gas to the cold spray gun 1 and the raw material powder feeding device 6. In the present embodiment, a compressed gas cylinder 2 storing high-pressure gas is used as a compressed gas supply unit. Therefore, in the present invention, the compressed gas supply unit may be configured to supply from, for example, a compressor or the like.

Examples of the working gas to be supplied to the cold spray gun 1 from the compressed gas supply unit and the gas used as the carrier gas to be supplied to the raw material powder feeding device 6 include helium, nitrogen, air, argon, and the mixed gas thereof. Depending on the raw material powder used for forming the coating film, it is possible to arbitrarily select the gas. In the case where a high linear velocity is realized, helium is preferably used.

In the present embodiment, the gas supply line 3 connected to the compressed gas cylinder 2 is branched into a working gas line 4 connected to the cold spray gun 1 and a carrier gas line 5 connected to the raw material powder feeding device 6.

The end of the working gas line 4 is connected to an inlet side end 22A of a gas heating pipe 22 disposed in a chamber 21 of the cold spray gun 1. A pressure regulator 11 and a flow meter 12 are interposed in the working gas line 4. The pressure regulator 11 and the flow meter 12 are used for adjusting the pressure and the flow rate of the working gas to be supplied to the gas heating pipe 22 from the compressed gas cylinder 2.

An end of the carrier gas line 5 is connected to the raw material powder feeding device 6. The raw material powder feeding device 6 is equipped with a hopper 13 containing raw material powder, a measure 14 for measuring raw material powder supplied from the hopper 13, and a raw material powder feeding line 15 for feeding the measured raw material powder to the chamber 21 of the cold spray gun 1 together with the carrier gas supplied from the carrier gas line 5. A pressure regulator 16, a flow meter 17, and a pressure gauge 18 are provided in the carrier gas line 5. The pressure regulator 16, the flow meter 17, and the pressure gauge 18 are used for adjusting the pressure and the flow rate of the carrier gas supplied from the compressed gas cylinder 2 to the raw material powder feeding device 6.

Examples of the raw material powder used in the present invention include metals, alloys, and intermetallic compounds. Specifically, a powder of nickel, iron, silver, chromium, titanium, copper, or alloys thereof may be exemplified.

Next, an embodiment of the cold spray gun 1 according to the present invention will be described in detail with reference to FIGS. 2 and 3. FIG. 2 is a schematic sectional view of the cold spray gun 1 according to the present embodiment, and FIG. 3 is a cross-sectional perspective view of the cold spray gun 1 shown in FIG. 2.

The cold spray gun 1 is equipped with a main body 20 in which a chamber 21 containing a high-pressure working gas in the interior thereof is constructed, and a cold spray nozzle 30 connected to a distal end of the chamber 21. In the drawing, reference numeral 28 denotes a piece for rectifying a working gas flow in the chamber 21 so as not to be turbulent. The main body 20 is constituted from a bottomed cylindrical piece having a pressure-resistant performance capable of withstanding a high pressure of, for example, 3 MPa to 10 MPa. It is preferable that the main body 20 be constituted from, for example, a stainless steel alloy having conductivity or a nickel-based heat resistant alloy.

In the chamber 21, there is arranged a gas heating pipe 22 constituted from a heating resistor which causes resistance heating by being energized and heats a working gas flowing into the interior of the chamber to a high temperature equal to or lower than the melting point or the softening point of the raw material powder described above. In the present invention, any material selected from metals, conductive ceramics, and the like may be used as the heating resistor that constructs the gas heating pipe 22 so long as it is a material that generates heat by being energized. However, in view of the degree of freedom in shape processing and mechanical strength, it is preferable to use an alloy material for manufacture. This is because the alloy material is superior in corrosion-resistance performance and heat-resistance performance to pure metal constructing the alloy, and is usually large in electric resistance.

Among alloy materials, stainless steels, being iron-based alloys include a lot of types and having established processing techniques, are advantageous in terms of cost. However, in consideration of heating the working gas to a temperature of 1200° C. or higher, the stainless steels have uncertainty in heat-resistance performance and corrosion-resistance performance. Therefore, it is preferable that the heating resistor be made of a heat-resistant corrosion-resistant material selected from the group consisting of iron-based alloys, cobalt-based alloys, and the like, which have a heat-resistant performance equal to or higher than Inconel 600 (trademark), which is a nickel-based alloy. Specifically, the optimum material may be selected in consideration of the type of working gas used, the amount of pressure, the maximum temperature for heating the working gas, the manufacturing cost, and the like. For alloys other than Inconel type alloys, Hastelloy (registered trademark) can be used for a nickel-based alloy, Incoloy (trademark) for an iron-based alloy, and S810 for a cobalt-based alloy.

In a heating method of the working gas using the gas heating pipe 22 of the heating resistor, it is generally considered that the temperature of the working gas is uniquely determined from the electric resistance, that is, the length of the heating resistor, assuming that the amount of energization is constant. However, when the heating resistor is short, the contact time between the working gas and the heating resistor becomes short, so that sufficient heating may not be possible. In general, the higher the linear velocity of the working gas in the gas heating pipe 22, the thinner a boundary layer becomes and the larger the heat transfer from the gas heating pipe 22 to the working gas becomes, so that a specific gas temperature can be obtained even if the distance of the gas heating pipe 22 is shortened. Further, the smaller the inner diameter of the gas heating pipe 22, the higher the linear velocity of the working gas in the gas heating pipe 22 become, but the pressure loss in the gas heating pipe 22 becomes larger. Therefore, it is preferable to employ a proper inner diameter and a length of the gas heating pipe 22.

Specifically, it is preferable that the pipe length of the gas heating pipe 22 is set in accordance with the heating temperature of the target working gas. When the flow rate of the working gas is assumed to be about 1000 SLM per minute, a length of the pipe length of the gas heating pipe 22 is preferably 0.8 m to 1.2 m.

Further, it is preferable that the gas heating pipe 22 has a thickness of 0.5 mm to 3.0 mm. It is because when the thickness of the gas heating pipe 22 is less than 0.5 mm, the mechanical strength is reduced, and damage of visual property such as breakage or depression is liable to occur at the time of handling. It is because when the thickness of the gas heating pipe 22 is greater than 3.0 mm, the electric resistance decreases, and the amount of energization required to obtain a desired heat generation amount increases. In addition, it is because the mass of the gas heating pipe 22 is too large, making the handling difficult, and at the same time, a large cost is required for the power source for energization and the heating resistor itself, which is not preferable.

Further, the inner diameter of the gas heating pipe 22 is preferably 3 mm to 16 mm, and more preferably 4 mm to 10 mm. For example, when the inner diameter of the throat portion, described later, of the cold spray gun is about 2 mm, the linear velocity of the working gas sprayed from the throat portion is approximately sonic velocity. Therefore, when the inner diameter of the gas heating pipe 22 is less than 3 mm, the linear velocity of the working gas flowing in an interior of the gas heating pipe 22 becomes a high speed of ¼ or more of the sonic velocity, so that the pressure loss becomes large. In this case, when the pressure in the compressed gas cylinder 2, which is a source of the working gas, is reduced, fluctuation of the linear velocity of the working gas flowing interior of the gas heating pipe 22 may appear. The fluctuations of the linear velocity of the working gas are not preferred because they have a large impact on the quality of the formed coating film. On the other hand, when the inner diameter of the gas heating pipe 22 exceeds 16 mm, the linear velocity of the working gas flowing in the interior of the gas heating pipe 22 becomes about 1/16 or lower as compared with the case where the inner diameter is 4 mm, so that there is no problem due to the pressure loss. However, the contact area between the gas heating pipe 22 and the working gas is reduced. Further, when the linear velocity is reduced, the thickness of the boundary film between the inner wall of the gas heating pipe 22 and the working gas is increased, and the heat transfer speed from the gas heating pipe 22 to the working gas is reduced. As a result, the heat transfer efficiency tends to be down, which is not preferable.

Further, it is preferable that the number of turns in the coil shape is 3 to 10. It is because when the number of turns of the coil is smaller than 3, the coil diameter becomes large and it becomes difficult to arrange the coil in the existing chamber 21. On the other hand, when the number of turns of the coil shape exceeds 10, the coil diameter becomes small, but the pitch in the coil shape becomes narrow, so that the risk that adjacent pipe portions come into contact with each other is increased.

The gas heating pipe 22 is connected to a working gas line 4 drawn out of the chamber 21 at the inlet side end 22A and through which a high-pressure working gas from the compressed gas cylinder 2 is supplied. The outlet side end 22B of the gas heating pipe 22 is opened in the chamber 21. In the present embodiment, it is preferable that the outlet side end 22B of the gas heating pipe 22 is open in the axial direction of the chamber 21 having a cylindrical shape toward an opposite side to a side where the cold spray nozzle 30 is provided. This is for uniformizing the pressure of the working gas sprayed from the gas heating pipe 22 in the chamber 21.

In the present embodiment, the gas heating pipe 22 is arranged in the chamber 21 via the insulating part 23 to prevent short circuit in portions other than the inlet side end 22A and the outlet side end 22B, and only the outlet side end 22B of the gas heating pipe 22 is arranged so as to be in contact with any of the inner walls of the chamber 21. The insulating part 23 is not particularly limited as long as it is superior in insulation performance, heat-resistance performance and pressure-resistance performance, and, for example, ceramics or the like can be used.

A voltage is applied from a power supply 24 between the inlet side end 22A of the gas heating pipe 22 drawn out to the outside of the chamber 21 and the conductive main body 20 that constructs the chamber 21 to which the outlet side end 22B is in contact, so that the gas heating pipe 22 causes resistance heating by being energized. Accordingly, the working gas passing through the interior is heated to a high temperature equal to or lower than the melting point or softening point of the raw material powder to be used by heat generation of the gas heating pipe 22, and the working gas contained in the chamber 21 in which the gas heating pipe 22 is disposed is also heated. In contrast to the case where a heater for heating the working gas is provided in the exterior, the gas heating pipe 22 is provided in the chamber 21 in which the working gas is contained, so that heat loss due to heat spreading can be greatly suppressed. The temperature and the working gas temperature of the gas heating pipe 22 can be controlled by a current flowing through the gas heating pipe 22.

A chamber outlet 25 is formed on one surface 20A of the main body 20 of the cold spray gun 1 on which the gas heating pipe 22 is disposed, and a cold spray nozzle 30 communicating with the chamber 21 in the interior of the main body 20 is connected to the chamber outlet 25. A raw material powder feeding nozzle 26 connected to the raw material powder feeding line 15 described above is inserted into the other surface 20B of the main body 20 opposite to the one surface 20A to which the cold spray nozzle 30 is connected. The raw material powder feeding nozzle 26 is preferably inserted into the chamber 21 so as to be coaxial with the central axis of the cold spray nozzle 30 connected to the one surface 20A of the main body. A powder port 27 at the distal end of the raw material powder feeding nozzle 26 is opened in the vicinity of the chamber outlet 25 of the chamber 21. In this case, although the powder port 27 is formed to have a diameter smaller than that of the chamber outlet 25, it is preferable that the chamber outlet 25 is tapered toward the outlet. It is because such inconvenience that the raw material powder sprayed from the powder port 27 flows back into the chamber 21 and scatters in the chamber 21 can be suppressed.

The cold spray nozzle 30 is equipped with a tapered portion 32 formed in a conical tapered shape formed from a nozzle inlet 31 at the distal end over an extending direction, a narrow throat portion 33 continuing to the tapered portion 32, and an expanded portion 34 formed in a conical shape extending from the throat portion 33 to a nozzle outlet 35 at the other end. In the present invention, the cold spray nozzle 30 may be an existing one, and a material, a shape, and the like are not particularly limited.

With the construction described thus far, an operation of forming a coating film by using the cold spray apparatus C according to the present embodiment will be described. First, a high-pressure working gas is supplied into the gas heating pipe 22 from a compressed gas cylinder 2 serving as a high-pressure gas supply unit through a gas supply line 3 and a working gas line 4. The gas heating pipe 22 is disposed in the chamber 21 of the cold spray gun 1, and causes resistance heating by energization between the inlet side end 22A and the outlet side end 22B by the power supply 24. Depending on the size and material of the gas heating pipe 22, the volume in the chamber 21, the type and flow rate of the working gas, the target heating temperature, and the like, the gas heating pipe 22 may supply a direct current of, for example, 500 A, 30 V to 40 V.

Therefore, the working gas flowing from the inlet side end 22A of the gas heating pipe 22 is heated to a high temperature equal to or lower than the melting point or the softening point of the raw material powder used for forming the coating film in the process of passing through the gas heating pipe 22, and is sprayed into the chamber 21 through the outlet side end 22B opened in the chamber 21.

Since the chamber 21 has a specific volume, the linear velocity of the working gas sprayed into the chamber 21 is regulated to a constant value. In particular, since the outlet side end 22B of the gas heating pipe 22 is formed to open toward a side opposite to a connection side where the cold spray nozzle 30 corresponding to the outlet of the chamber 21 is located, it is possible to spray the gas from the chamber outlet 25 to the cold spray nozzle 30 in a state in which the linear velocity of the working gas flow is regulated to be constant without being greatly influenced by pressure fluctuations from the compressed gas cylinder 2 or by pipe vibrations.

On the other hand, a high-pressure carrier gas is supplied to the raw material powder feeding device 6 from a compressed gas cylinder 2 as a high-pressure gas supply unit through a gas supply line 3 and a carrier gas line 5. The high-pressure carrier gas flows into the raw material powder feeding nozzle 26 provided on the cold spray gun 1 via the raw material powder feeding line 15 entraining a specific amount of raw material powder measured by the measure 14 in the raw material powder feeding device 6. The powder port 27 formed at the distal end of the raw material powder feeding nozzle 26 opens toward the cold spray nozzle 30 in the vicinity of the chamber outlet 25. Therefore, the carrier gas carrying the raw material powder is supplied to the high speed working gas flow in the vicinity of the chamber outlet 25.

The high speed working gas flow carrying the raw material powder supplied from the powder port 27 passes through the throat portion 33 from the tapered portion 32 of the cold spray nozzle 30, becomes a supersonic flow, and is sprayed from a nozzle outlet 35 located at the distal end of the expanded portion 34 formed in a conical shape of an inverted tapered shape. The raw material powder sprayed from the cold spray nozzle 30 collides with the surface of a base material 40 in a solid state and accumulates to form a coating film 41.

In the cold spray gun according to the present invention, since the gas heating pipe 22 through which the high-pressure working gas flows is arranged in the chamber 21 containing the high-pressure working gas, the pressure difference between the gas heating pipe 22 and the chamber 21 is reduced, and the load applied to the gas heating pipe 22 is reduced. Therefore, even if the pressure of the working gas in the gas heating pipe 22 is set to be high such as 5 MPa to 10 MPa, and the like, there is little fear of deformation or rupture of the gas heating pipe 22. Therefore, since the pressure difference between the interior and the exterior of the heating pipe is extremely low as compared with the method in the related art, it is possible to prevent the heating pipe from being destroyed even if the gas heating temperature is increased to a temperature for example, 1200° C., at which the yield stress of the material of the gas heating pipe is extremely low. For example, in the conventional heating method, when the temperature of the heater is set to 1000° C., the pressure difference between the interior and the exterior of the heating pipe is limited to about 5 MPa, but according to the present invention, the pressure difference between the inside and outside of the gas heating pipe can be set to about 0.5 MPa, so that the probability that the heating pipe is destroyed is eliminated even when the temperature of the gas heating pipe is increased to 1200° C. Therefore, according to the present invention, since the temperature of the working gas can be set to a higher temperature than that of the method of the related art, it is possible to realize a particle speed which is faster than the method of the related art by approximately 100 to 150 m/s.

Therefore, it is possible to realize a coating film formation which is high in adhesion efficiency and which is more compact and more superior in mechanical performances.

Further, since the gas heating pipe 22 is arranged in the chamber 21 containing the working gas at high temperature and high-pressure, heating is achieved also by heat spreading from the gas heating pipe 22, so that heat loss in the gas heating pipe 22 is reduced. Further, as described above, since the gas temperature of the gas heating pipe 22 can be set to be higher than that of the conventional gas heating pipe, it is possible to increase the linear velocity of the working gas. Therefore, the thickness of the boundary film between the inner wall of the gas heating pipe 22 and the working gas can be reduced, and the efficiency of heat transfer from the gas heating pipe 22 to the working gas flowing through the gas heating pipe 22 can be further improved. Therefore, the energy consumption can be greatly reduced compared to the case where an apparatus for heating the working gas is provided outside the chamber 21, and even when the heating temperature is the same as that of the conventional apparatus, it is possible to achieve compactness and lightweight of the entire apparatus.

In the cold spray gun and the cold spray apparatus according to the present invention, since the gas heating pipe for heating the working gas is disposed in the chamber, the heating efficiency of the working gas is high, and the working gas can be set to a high pressure and a high temperature. Therefore, the raw material powder can be stably heated to a specific high temperature with an achievement of compactness and lightweight of the entire cold spray apparatus.

The invention claimed is:

1. A cold spray gun for causing raw material powder to collide with a base material in a solid state and form a coating film thereon, the cold spray gun comprising:

a main body;

a raw material powder feeding nozzle configured to spray heated raw material powder carried on a carrier gas therefrom by supersonic flow together with a heated working gas, the main body having a chamber containing the raw material powder feeding nozzle;

a cold spray nozzle in communication with the raw material powder feeding nozzle at a chamber outlet on a cold spray nozzle connection side of the chamber; and a gas heating pipe arranged inside the chamber, the gas heating pipe comprising a heating resistor configured to provide resistance heating by being energized providing the heated working gas flowing into an interior of the gas heating pipe being heated by the heating resistor in the chamber, wherein the gas heating pipe further comprises a coil heater including a working gas flow passage formed in the interior of the gas heating pipe, and wherein the gas heating pipe is configured to open and direct the heated working gas to flow in an axial direction of the chamber toward the raw material powder feeding nozzle and direct the heated working gas to flow toward a working gas inlet side end of the chamber which is opposite the cold spray nozzle connection side of the chamber.

2. The cold spray gun according to claim 1, wherein the gas heating pipe is held in the chamber via an insulating part, and a working gas outlet side end is arranged in contact with a chamber inner wall.

3. A cold spray apparatus comprising the cold spray gun as claimed in claim 1.

4. A cold spray apparatus comprising the cold spray gun as claimed in claim 2.

5. The cold spray gun according to claim 1, wherein an outlet side end of the gas heating pipe is open in an axial direction of the chamber toward an opposite side of the chamber to a side of the chamber where the cold spray nozzle is provided.

6. The cold spray gun according to claim 5, wherein the gas heating pipe is held in the chamber via an insulating part, and a working gas outlet side end is arranged in contact with a chamber inner wall.

7. A cold spray apparatus comprising the cold spray gun as claimed in claim 5.

* * * * *